United States Patent [19]

Alley et al.

[11] Patent Number: 4,701,680

[45] Date of Patent: Oct. 20, 1987

[54] WALL BOX FLUORESCENT LAMP DIMMER

[75] Inventors: Robert P. Alley, Clifton Park; William H. Bicknell, Ballston Lake, both of N.Y.

[73] Assignee: General Electric Company, Schenectady, N.Y.

[21] Appl. No.: 780,142

[22] Filed: Sep. 26, 1985

[51] Int. Cl.[4] ..... H05B 41/16

[52] U.S. Cl. ..... 315/287; 315/307; 315/DIG. 4; 315/DIG. 7

[58] Field of Search ..... 315/DIG. 4, DIG. 7, 315/307, 287, 313, 170, 176

[56] References Cited

U.S. PATENT DOCUMENTS

| | | | |
|---|---|---|---|
| 3,875,458 | 4/1985 | Kappenhagen | 315/194 |
| 3,952,241 | 4/1976 | Takemura et al. | 315/307 |
| 4,350,935 | 9/1982 | Spira et al. | 315/DIG. 4 |
| 4,604,552 | 8/1986 | Alley et al. | 315/DIG. 4 |

*Primary Examiner*—David K. Moore
*Assistant Examiner*—T. Salindong
*Attorney, Agent, or Firm*—Marvin Snyder; James C. Davis, Jr.

[57] ABSTRACT

A wall box dimmer is connected to a conventional fluorescent lighting system for providing a wide range of dimming. Overvoltages generated during chopping of the AC input waveform are dissipated and the lighting level is modified to reduce the overvoltages. DC power for the control electronics is derived from the voltage across the dimmer.

16 Claims, 6 Drawing Figures

WALL BOX FLUORESCENT LAMP DIMMER

BACKGROUND OF THE INVENTION

The present invention relates in general to a retrofit fluorescent lamp dimming system for filament heated fluorescent lamps and more specifically to a fluorescent dimmer that is readily installable in a wall box.

Retrofit fluorescent lamp dimmers are capable of dimming the light output of fluorescent lamps connected in conventional ballasts by conditioning the AC power supplied to the ballast. In one exemplary prior art device, such as is shown in U.S. Pat. No, 4,350,935 to Spira et al., a portion or portions are removed from each half-cycle of the AC input waveform (by opening a series switch) resulting in periods of zero energy transfer to the lamps. The reduction in energy transfer results in a lowered light output from the lamps.

An improved fluorescent lamp dimming system of the prior art conditions the AC power supplied to the lighting system by chopping the input waveform in order to provide a variable duty cycle, low frequency input component which gives a variable light output, and to provide a high frequency component for maintaining filament heating at any amount of dimming without adding substantially to the light output. This improved system is described in U.S. patent application, Ser. No. 645,593 of Alley et al., filed Aug. 30, 1984, now U.S. Pat. No. 4,604,552, issued Aug. 5, 1986, which is a common assignment and which is hereby incorporated by reference.

In the above-mentioned dimming systems, a return circuit is connected across the ballast. The return circuit clamps the voltage across the ballast which could otherwise rise to extremely high levels during rapid switching of the current supplied to the inductive ballast load. In particular, the return circuit may be comprised of a switch connected across the ballast which closes only when power from the AC supply is switched off. In this way, the transients generated by the ballast during switching of the series switch are circulated through the return circuit, thus protecting the series switch from overvoltages and utilizing the transients to supply power to the lamps.

When retrofitting small lighting installations, such as a single room, for dimming, it would be desirable to have to access the system wiring only at the wall box, i.e. in the space provided for the room's on-off switch. However, only one wire is usually available at the wall box. Therefore, no return circuit can be conveniently used to clamp the ballast voltage and circulate the stored energy. It is also difficult to provide a supply of power for any control circuitry which might be used since only one terminal of the AC line is directly accessible.

OBJECTS OF THE INVENTION

It is a principal object of the present invention to provide a fluorescent lamp dimming circuit which maintains filament heating during dimming and which requires direct connection to only one terminal of the fluorescent lamp ballast.

It is another object of the invention to provide a fluorescent lamp dimming circuit which is adapted to be installed at the location of the on-off wall switch.

It is a further object of the invention to provide a fluorescent dimming circuit adapted to be installed in a wall box and which dissipates a minimum amount of power.

It is another object of the invention to provide a wall box fluorescent lamp dimming circuit adapted to be electronically controlled, such as by a microprocessor.

It is yet another object of the invention to provide a wall box fluorescent dimming circuit which energizes its control electronics with DC power without being connected across the AC power supply.

SUMMARY OF THE INVENTION

These and other objects of the present invention are achieved by a dimming circuit for connecting in series with a fluorescent lighting system, the lighting system including a nondimming ballast for supplying power to a fluorescent lamp. The dimming circuit comprises a full-wave diode rectifier, a switch branch, an overvoltage dissipating branch and a gate control circuit.

One input terminal of the rectifier is adapted to be connected to a source of AC power and the other input terminal is adapted to be coupled to one terminal of the ballast. The switch branch is coupled between the output terminals of the rectifier and includes an on-off switch connected in series with a controllable semiconductor switching device.

The overvoltage dissipating branch includes a voltage sensitive device exhibiting a dynamic resistance which is connected to one output terminal of the rectifier. The dissipating branch also includes a resistor connected to the other output terminal of the rectifier. The voltage sensitive device and the resistor are connected in series.

The gate control circuit is coupled to the resistor and to the controllable semiconductor switching device, and it includes zero crossing detection means for detecting zero crossings of the current supplied to the ballast by the AC power source. The gate control circuit provides a gate signal for rapidly switching the controllable semiconductor switching device on and off during a notch period within each half-cycle of current supplied by the AC source. The beginning and ending of the notch period is determined by the gate control circuit in response to a light level command. The gate control signal also turns on the controllable semiconductor switching device during the portions of each half-cycle outside the notch period to establish a low frequency, variable duty cycle current which results in a controllable light output from the lamp.

The dimming circuit may alternatively be configured without a diode rectifier by employing a complementary switching device.

BRIEF DESCRIPTION OF THE DRAWINGS

The novel features of the invention are set forth with particularity in the appended claims. The invention itself, however, as to organization and method of operation, together with further objects and advantages thereof, may best be understood by reference to the following description taken in conjunction with the accompanying drawings in which:

DETAILED DESCRIPTION OF THE INVENTION

Figure 1:
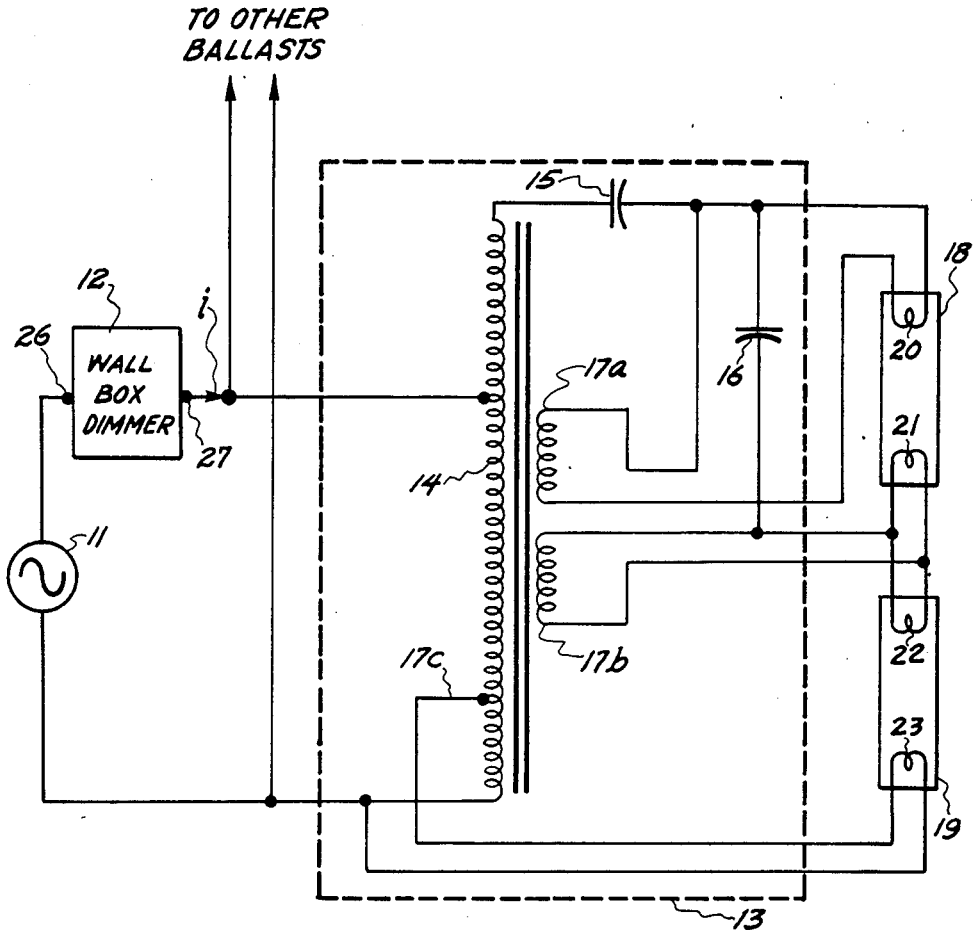
FIG. 1 is a schematic diagram of a conventional nondimming ballast and fluorescent lamps showing connections to a wall box dimmer.

Referring now to the drawings, FIG. 1 is a part block diagram, part schematic of a wall box fluorescent dimming system according to the present invention. A wall box dimmer 12 having two terminals 26 and 27, is connected between an AC source 11, typically a 60 hertz power line, and a conventional nondimming rapid-start fluorescent ballast 13 (an 8G1022W ballast manufactured by the General Electric Company is shown in the Figure). Ballast 13 powers series connected fluorescent lamps 18 and 19 and filament heaters 20–23 of lamps 18 and 19. Ballast 13 includes autotransformer 14, power factor correcting capacitor 15, starting capacitor 16 and filament secondaries 17*a*, and 17*b*.

Wall box dimmer 12 is connected in one AC line between ballast 13 and AC source 11, such as in the location typically occupied by an on-off wall switch. Since wall box dimmer 12 is connected in series with ballast 13, it can neither clamp the ballast voltage while circulating stored energy nor sense voltage zeroes of AC source 11. Thus, according to the present invention, wall box dimmer 12 conditions the current i flowing to ballast 13 (and any other ballasts connected in parallel with ballast 13) to achieve dimming control.

Figure 2:
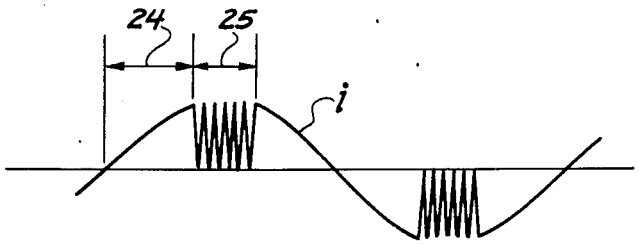
FIG. 2 is a waveform diagram of the current supplied by the wall box dimmer to the ballast.

In previously mentioned application Ser. No. 645,593, it was disclosed that lamps 18 and 19 may be dimmed by lowering the duty cycle of the low frequency AC line voltage during each half-cycle of line voltage and adding a high frequency component to the ballast voltage either continuously or during the off portions of the low frequency component in order to maintain filament heating. In the present invention, wall box dimmer 12 also performs this function except that a current reference is substituted for the voltage reference. Thus, the input current waveform is chopped by wall box dimmer 12 as shown in FIG. 2. A notch delay period 24 is measured from a zero crossing of current i to the beginning of a notch period 25. Current is chopped during notch period 25 to produce a series of high frequency pulses which provide power to filaments 20–23 but which make essentially no contribution to the light output of lamps 18 and 19. By varying the length of notch delay 24 and the width of notch period 25, a variable light output from lamps 18 and 19 results. The frequency of the high frequency pulses is preferably at least 10 times greater than the frequency of source 11.

Figure 3:
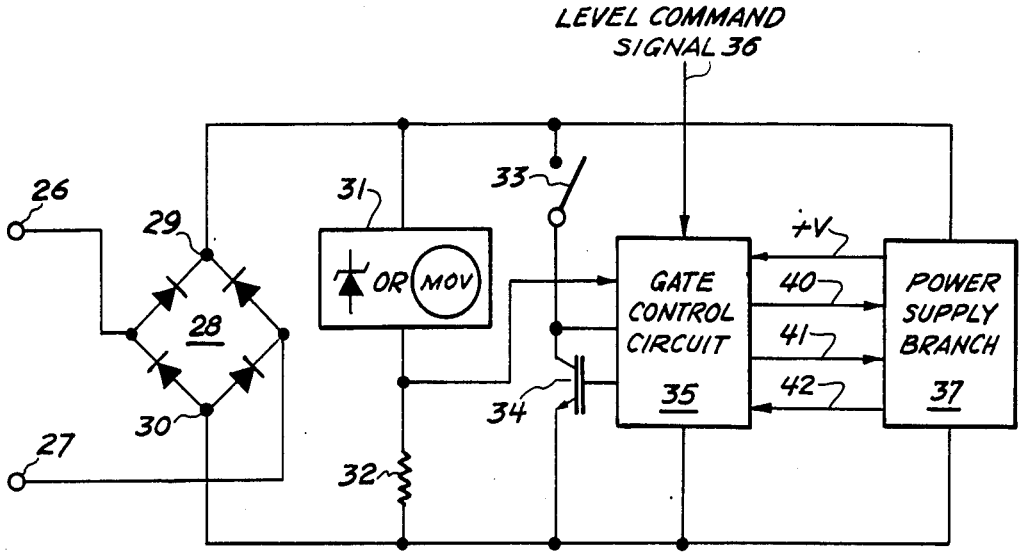
FIG. 3 is a part schematic, part functional block diagram of one embodiment of the wall box dimmer of the invention.

A part schematic, part functional block diagram of wall box dimmer 12 is shown in FIG. 3. Input terminals 26 and 27 provide connection between a diode rectifier 28 and the fluorescent lighting system of FIG. 1. Rectifier 28 includes a positive output terminal 29 and a negative output terminal 30. An overvoltage dissipating branch comprising a voltage sensitive device 31 (e.g. a zener diode or a metal-oxide varistor, MOV) and a resistor 32 is connected between terminals 29 and 30. A switch branch comprising an on-off switch 33 and a semiconductor switch 34 is likewise connected between terminals 29 and 30. Switch 34 is shown as an insulated gate transistor (IGT), which is available from General Electric Company, Semiconductor Business Division, Syracuse, N.Y., although other devices such as a field-effect transistor (FET) or a bipolar transistor could alternatively be used. Also connected between terminals 29 and 30 is a power supply branch 37 for providing a regulated DC voltage +V to a gate control circuit 35. Gate control circuit 35 is coupled to the positive electrode (collector) of IGT 34, to the control electrode (gate) of IGT 34, to ground and to the junction between voltage sensitive device 31 and resistor 32. In addition to receiving voltage +V from power supply branch 37, gate control 35 exchanges several signals with power supply branch 37 on lines 40, 41 and 42. Gate control circuit 35 chops the current flowing through the switch branch in response to a level command signal 36 by way of a gate signal provided to the gate of IGT 34.

In response to level command signal 36, gate control circuit 35 selects an appropriate notch delay 24 and notch width 25, as shown in FIG. 2, which corresponds to the desired light output. Gate control circuit 35 includes zero crossing detection means for detecting zero crossings of the input current waveform in order to identify the beginning of notch delay 24 (FIG. 2). Current i may be sensed, for example, by measuring the voltage across IGT 34 since the voltage drop versus conducted current relationship for this device is fairly linear, although a current transformer or a current shunt could also be used. Other functions of gate control circuit 35 will be discussed below. However, a detailed description of a dimming control system suitable for implementing gate control circuit 35 is the subject of U.S. Pat. Applications Ser. No. 780,548 and Ser. No. 780,143 both of Alley et al., of common assignment and filed concurrently herewith, on Sept. 26, 1985 which are hereby incorporated by reference.

Voltage transients (i.e. overvoltages) cannot be clamped when using the wall box configuration of FIG. 3. Therefore, an overvoltage dissipating branch is provided in order to protect IGT 34. Voltage sensitive device 31 exhibits a dynamic resistance such that its resistance decreases to substantially zero when the voltage across it exceeds a threshold value. The threshold value of device 31 and the resistance of resistor 32 are selected such that the overvoltage dissipating branch will conduct and dissipate energy at a voltage lower than the voltage rating of IGT 34. Further, each time that device 31 conducts, a pulse is provided to gate control circuit 35. It has been found that overvoltages are generated only within certain dimming ranges (i.e. certain notch delays and widths). Typically, selecting a dimming level between 50% and 100% of full light output would result in unacceptably large transients. Therefore, when gate control circuit 35 receives overvoltage pulses, it automatically modifies its light level command in a direction which tends to reduce overvoltages. For instance, when operating at full brightness and after receiving a level command signal corresponding to a light output of 90%, the level command signal (or the corresponding level reference used within gate control circuit 35) is reduced until overvoltage pulses discontinue. On the other hand, if light level is commanded to increase to 75% and overvoltages result, the level command signal is increased by gate control circuit 35 until the overvoltages cease.

Figure 4:
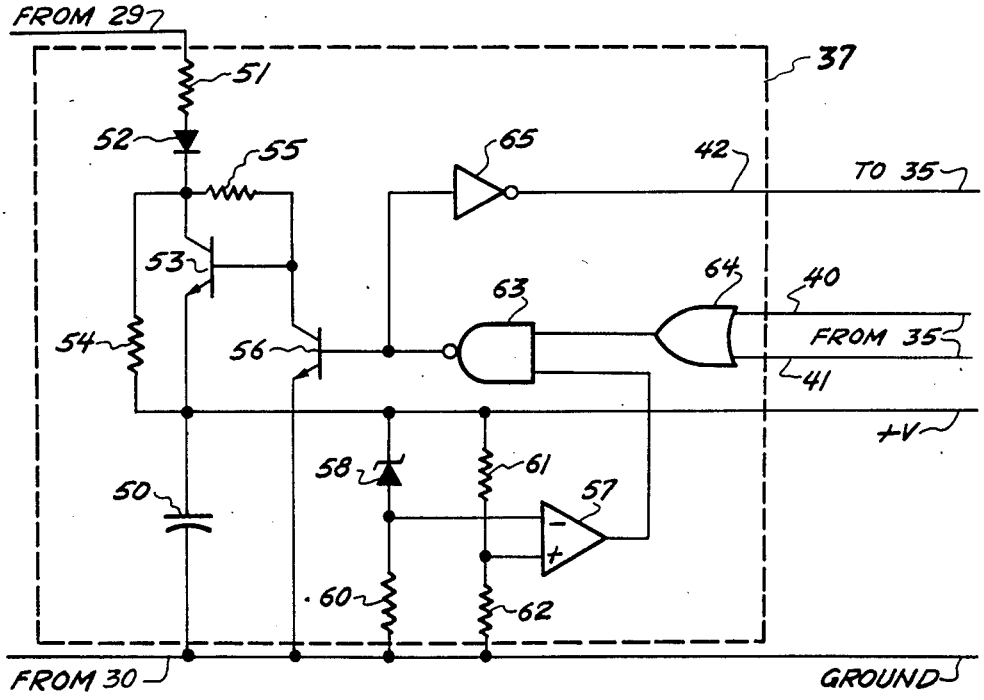
FIG. 4 is a schematic diagram showing the power supply branch of FIG. 3 in greater detail.

The control electronics of gate control circuit 35 require a source of one or more regulated DC voltages, e.g. +15 or +5 volts. As shown in FIG. 4, power supply branch 37 includes a capacitor 50 which is charged to DC voltage +V, the voltage required by gate control circuit 35. Any other DC voltages needed may be obtained by employing voltage regulators. The remainder of the circuit in FIG. 4 maintains the predetermined charge on capacitor 50.

A resistor 51 couples terminal 29 to the anode of a diode 52. The cathode of diode 52 is connected to the collector of a transistor 53. The emitter of transistor 53 is connected to one side of capacitor 50, the other side of capacitor 50 being connected to terminal 30. The collector and emitter of transistor 53 are coupled by a high-ohm resistor 54. A resistor 55 couples the emitter of transistor 53 to its base. The base of transistor 53 is connected to the collector of a transistor 56. The emitter of transistor 56 is connected to the other side of capacitor 50 (i.e. ground). The cathode of a zener diode 58 is connected to the one side of capacitor 50 (i.e. +V). The anode of zener diode 58 is connected to the inverting input of a comparator 57 and is coupled to ground through a resistor 60. A series-connected pair of resistors 61 and 62 are connected across capacitor 50. The junction of resistors 61 and 62 is connected to the noninverting input of comparator 57.

Lines 40 and 41 from gate control circuit 35 are connected to the inputs of an OR gate 64. The output of OR gate 64 is connected to one input of a two-input NAND gate 63. The output of comparator 57 is connected to the other input of NAND gate 63. The output of NAND gate 63 is connected to the base of transistor 56 and to the input of an inverter 65. The output of inverter 65 is connected to line 42 and supplied to gate control circuit 35.

The circuit of FIG. 4 derives power for gate control circuit 35 from the voltage applied across the switch branch by rectifier 28, as shown in FIG. 3. In operation, capacitor 50 receives charge when the voltage on capacitor 50 is below a predetermined value set by zener diode 58 and resistors 60–62, but only if either (1) the line current i is near a current zero, or (2) the switch branch is continuously off (i.e. either the on-off switch or the IGT is open and the lamps are off). Thus, power is supplied during all operating conditions (under all light levels) from no load to full on.

More specifically, by turning on transistor 53, capacitor 50 may be charged. Assuming that transistor 56 is off, base current is supplied to transistor 53 through resistor 51, diode 52 and resistor 55, thus turning transistor 53 on. When transistor 56 turns on it removes base current from transistor 53 which turns off. Thus, transistor 56 is turned off when capacitor 50 is to be charged and is turned on otherwise.

Transistor 56 is turned off only when both inputs to NAND gate 63 are high. The input connected to the output of comparator 57 is high only when the capacitor voltage is below the predetermined value. The other input of NAND gate 63 is high when either of the signals on lines 40 or 41 connected to OR gate 64 are high. Line 40 is high when the switch branch (FIG. 3) is turned off, thus allowing capacitor 50 to be charged at any point in the input cycles. This provides power to the gate control circuit even when the lamps are off so that previous settings (commands) are not lost. Line 41 is connected to the output of the zero crossing means of gate control circuit 35 (FIG. 3). The signal on line 41 is high in the vicinity of each zero crossing. When the lamps are on, either dimmed or at full on, capacitor 50 is charged only near zero crossings so as to minimize interferance with notch operations.

The inverter 65 output signal is high whenever capacitor 50 is being charged. This signal is provided to gate control circuit 35 via line 42 so that IGT 34 (FIG. 3) may be forced open during charging (if it is not already open).

Figure 5:
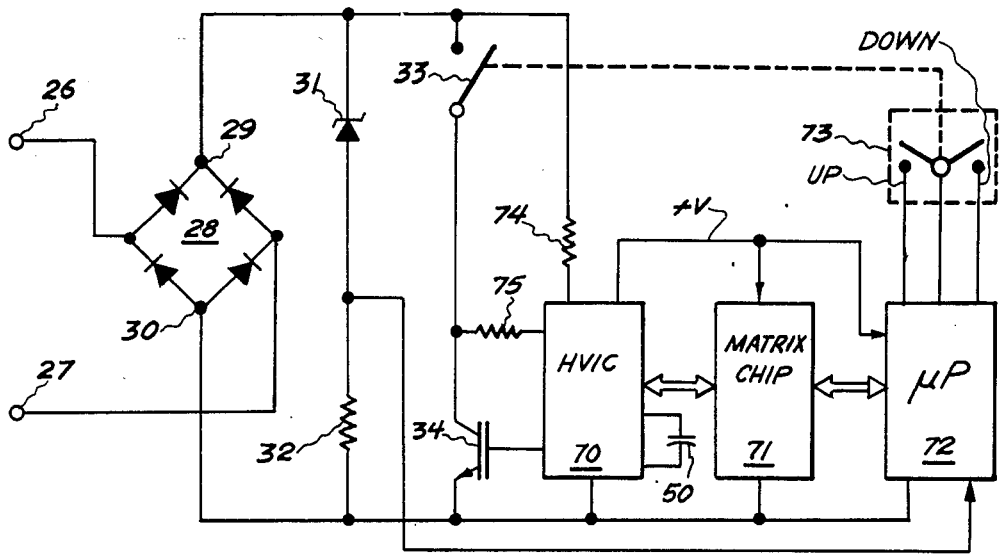
FIG. 5 is a schematic diagram of a preferred implementation of the invention.

An embodiment of the present invention adapted to meet the space and power consumption constraints related to placement in a wall box is shown in FIG. 5. In this embodiment, the gate control circuit and the power supply branch are implemented within three integrated circuits, a high voltage integrated circuit (HVIC) 70, a matrix chip 71 and a microprocessor 72, which are the subject of previously mentioned, copending application Ser. No. 780,548. In particular, power supply branch 37 (FIG. 3) may be implemented by a portion of HVIC 70 in conjunction with capacitor 50. HVIC 70 may also contain a driver for the IGT switch and means for supplying matrix chip 71 with current zero signals and a signal representing the instantaneous current value. A resistor 74 couples HVIC 70 to terminal 29 as a source of current for the power supply branch. HVIC 70 is coupled to the collector of IGT through a resistor 75 and is coupled directly to the IGT gate and emitter and to matrix chip 71.

Matrix chip 71 is coupled to microprocessor 72. Matrix chip 71 includes counters for providing proper timing and width of each notch period and for generating the gate signal (including high frequency pulses) which is provided to HVIC 70. Matrix chip 71 also includes means for obtaining the time integral of current i as an indication of the light being produced. A new current integral value is automatically stored within matrix chip 71 once each half-cycle. Additionally, matrix chip 71 blanks out the instantaneous current input from HVIC 70 during the notch periods since the high frequency current pulses do not contribute materially to light output.

Microprocessor 72 provides for closed loop feedback control of the lighting system current. It also receives signals commanding the desired light level (e.g. level command signal 36 of FIG. 3). After computing the appropriate current integral reference for the commanded light level and determining the appropriate notch delay, notch width and number of high frequency pulses needed to fill the notch, microprocessor 72 loads these values into matrix chip 71. Microprocessor 72 further provides clock signals for system timing.

Microprocessor 72 also receives overvoltage pulses from the overvoltage dissipating branch as previously described. In response to an overvoltage pulse, microprocessor 72 modifies the current integral reference to change the light level in a direction consistent with the direction of the last change in the level command, until overvoltage pulses discontinue.

FIG. 5 further shows means for providing the level command to microprocessor 72 in conjunction with controlling the on-off switch. On-off switch 33 is mechanically connected to an up-down single-pole double-throw switch 73. Thus, switch 33 may be push-push for on-off control while switch 73 is tilt for up-down control.

Figure 6:
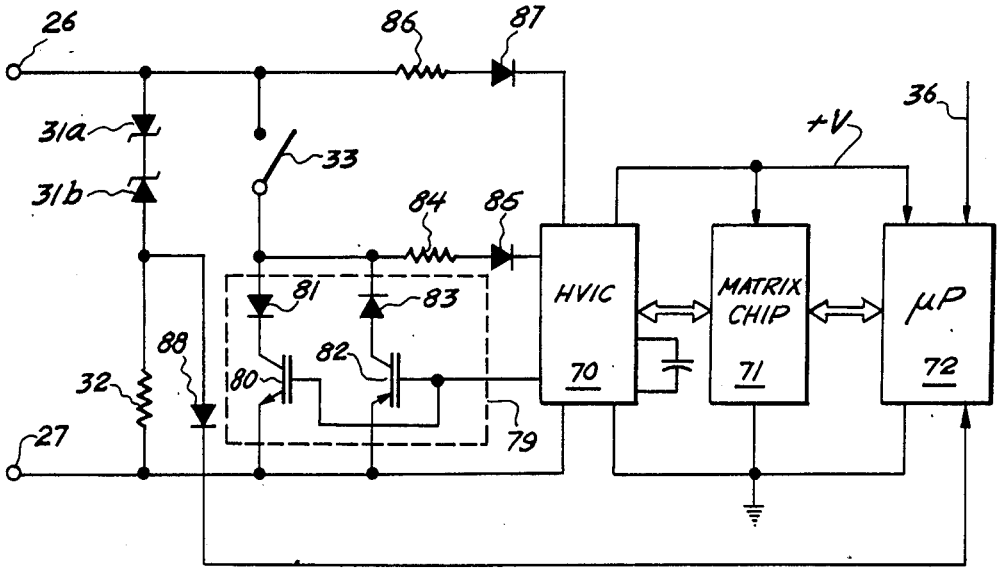
FIG. 6 is a schematic diagram of an alternative implementation of the invention.

Turning now to FIG. 6, a complementary switching device 79 is employed in the switch branch so that the diode rectifier (and its losses) may be eliminated and connection of the circuit branches made directly to terminals 26 and 27. Such a complementary device includes, for example, a pair of switches 80 and 82 connected in parallel for conducting in opposite directions.

Switch 80 is an n-channel IGT and switch 82 is a p-channel IGT. Switches 80 and 82 may be of the blocking type (i.e. conduct only in one direction) and then series blocking diodes 81 and 83 are not needed. If they are not of the blocking type, then a pair of external diodes may be added as shown by diodes 81 and 83.

Complementary switch 79 is thus an AC switch which is controlled from a single gate signal. Another example of a complementary switch is the BLS100 bilateral switch available from Siliconix of Santa Clara, Calif. which is a complementary blocking field-effect device.

Also shown in FIG. 6 is a pair of zener diodes 31*a* and 31*b* for exhibiting a dynamic resistance to an AC signal. A varistor may alternatively be used as shown in FIG. 3. Overvoltage pulses are coupled to microprocessor 72 via a diode 88. Input terminal 26 is coupled to the power supply branch within HVIC 70 via the series-connected pair of a resistor 86 and a diode 87. The voltage across complementary switch 79 (used to derive current information) is supplied to HVIC 70 through a resistor 84 and a diode 85.

FIG. 6 also shows an alternative embodiment for supplying level command signal 36. In this case, on-off switch 33 is independent and the level command is supplied from a remote location (e.g. a digital command from a central controller or computer).

The foregoing describes a fluorescent dimming circuit which maintains filament heating during dimming and which requires direct connection to only one terminal of the fluorescent ballast. The circuit has a size and power dissipation which allows it to be placed in a wall box. The circuit derives DC power for the control electronics without being connected across the AC supply.

While preferred embodiments of the present invention have been shown and described herein, it will be obvious that such embodiments are provided by way of example only. Numerous variations, changes and substitutions will occur to those skilled in the art without departing from the spirit of the invention. Accordingly, it is intended that the invention be limited only by the scope of the appended claims.

What is claimed is:

1. A dimming circuit for connecting in series with a fluorescent lighting system, said lighting system including a nondimming ballast for supplying power to a fluorescent lamp, said dimming circuit comprising;

a full-wave diode rectifier have input and output terminals, one of the input terminals of said rectifier adapted to be connected to a source of AC power and the other input terminal of said rectifier adapted to be coupled to one terminal of said ballast;

a switch branch coupled between the output terminals of said rectifier including an on-off switch connected in series with a controllable semiconductor switching device;

an overvoltage dissipating branch including a voltage sensitive device exhibiting a dynamic resistance connected to one output terminal of said rectifier and including a resistor connected to the other output terminal of said rectifier, said voltage sensitive device and said resistor being connected in series; and a gate control circuit coupled to said resistor and said controllable semiconductor switching device, said gate control circuit including zero crossing detection means for detecting zero crossings of the current supplied to said ballast by said AC power source, said gate control circuit providing a gate signal for rapidly switching said controllable semiconductor switching device on and off during a notch period within each half-cycle of current supplied by said AC power source, the beginning and ending of said notch period being determined by said gate control circuit in response to a level command, said gate signal turning said controllable semiconductor switching device on during the portions of each half-cycle outside said notch period to establish a low frequency, variable duty cycle current which results in a controllable light output from said lamp.

2. The dimming circuit of claim 1 further comprising a local power supply branch coupled to said output terminals of said rectifier and to said gate control circuit, said power supply branch adapted to supply a regulated DC voltage to said gate control circuit, said power supply branch including a capacitor and charging means for maintaining a predetermined voltage on said capacitor, said charging means being operative to charge said capacitor when the voltage of said capacitor is less than said predetermined voltage and when either the current supplied by said AC power source is within a predetermined magnitude of a zero crossing or said switch branch is continuously off.

3. The dimming circuit of claim 1 wherein said gate control circuit further includes means for altering said beginning and ending of said notch period in response to an overvoltage pulse received from said resistor, said notch period being altered so as to reduce the overvoltage condition.

4. The dimming circuit of claim 2 wherein said gate control circuit further includes means for turning said controllable semiconductor switching device off when said charging means is charging said capacitor.

5. The dimming circuit of claim 1 wherein said controllable semiconductor switching device is comprised of an IGT.

6. The dimming circuit of claim 5 further comprising driving means coupling said gate control circuit to said IGT for turning said IGT on and off in response to said gate signal.

7. The dimming circuit of claim 1 wherein said voltage sensitive device is comprised of a zener diode coupled in series-blocking fashion between said output terminals of said rectifier.

8. The dimming circuit of claim 1 wherein said voltage sensitive device is comprised of a varistor.

9. A dimming circuit for connecting in series with a fluorescent lighting system, said lighting system including a nondimming ballast for supplying power to a fluorescent lamp, said dimming circuit comprising:

first and second terminals, said dimming circuit adapted to have one of said terminals connected to a source adapted to have one of said terminals connected to a source of AC power and the other one of said terminals coupled to one terminal of said ballast;

a switch branch coupled between said first and second terminals including an on-off switch connected in series with a complementary switching device, said on-off switch being connected to said first terminal and said complementary switching device being connected to said second terminal;

an overvoltage dissipating branch including a voltage sensitive device exhibiting a dynamic resistance connected in series with a resistor; and a gate control circuit coupled to said resistor and said complementary switching device, said gate control circuit including zero crossing detection means for detecting zero crossings of the current supplied to said ballast by said AC power source, said gate control circuit adapted to provide a gate signal for rapidly switching said complementary switching device on and off during a notch period within each half-cycle of current supplied by said AC power source, the beginning and ending of said notch period being determined by said gate control circuit in response to a level command, said gate signal turning said complementary switching device on during the portion of each half-cycle not within said notch period to establish a low frequency, variable duty cycle current which results in a controllable light output from said lamp.

10. The dimming circuit of claim 9 further comprising:

a local power supply branch coupled to said first and second terminals and to said gate control circuit, said power supply branch adapted to supply a regulated DC voltage to said gate control circuit, said power supply branch including a capacitor and charging means for maintaining a predetermined voltage on said capacitor, said charging means being operative to charge said capacitor when the voltage on said capacitor is less than said predetermined voltage and when either the current supplied by said AC power source is within a predetermined magnitude of a zero crossing or said switch branch is continuously off; and a diode having its anode connected to said first terminal and its cathode connected to said power supply branch for supplying unidirectional current to said power supply branch.

11. The dimming circuit of claim 9 wherein said gate control circuit further includes means for altering said beginning and ending of said notch period in response to an overvoltage pulse received from said resistor so as to reduce the overvoltage condition.

12. The dimming circuit of claim 10 wherein said gate control circuit further includes means for turning said comtemplary switching device off when said charging means is charging said capacitor.

13. The dimming circuit of claim 9 wherein said complementary switching device is comprised of a complementary blocking semiconductor device.

14. The dimming circuit of claim 13 further comprising driving means coupling said gate control circuit to said complementary blocking semiconductor device for turning said complementary blocking semiconductor device on and off in response to said gate signal.

15. The dimming circuit of claim 9 wherein said voltage sensitive device is comprised of a pair of zener diodes connected in series opposition.

16. The dimming circuit of claim 9 wherein said voltage sensitive device is comprised of a varistor.

* * * * *